US005803285A

United States Patent [19]

Hirota

[11] Patent Number: 5,803,285

[45] Date of Patent: Sep. 8, 1998

[54] CORK CAP FOR USE WITH A CORK TO PLUG THE MOUTH OF A BOTTLE

[76] Inventor: Koji Hirota, 3-12-704, Tosabori 2-chome, Nishi-ku, Osaka, Japan

[21] Appl. No.: 798,470

[22] Filed: Feb. 10, 1997

[30] Foreign Application Priority Data

May 28, 1996 [JP] Japan ..... 8-133622

[51] Int. Cl.[6] ..... B65D 39/00

[52] U.S. Cl. ..... 215/296; 215/355; 81/315

[58] Field of Search ..... 215/296, 300, 215/301, 355, 364, 299; 81/3.15, 3.41, 3.47, 3.48; 217/111, 113

[56] References Cited

U.S. PATENT DOCUMENTS

| | | | |
|---|---|---|---|
| 2,641,375 | 6/1953 | Steuart . | |
| 3,638,821 | 2/1972 | Guala | 215/364 X |
| 4,182,458 | 1/1980 | Meckler | 215/296 X |
| 4,394,922 | 7/1983 | Wimmer | 215/300 |
| 4,932,543 | 6/1990 | Martus | 215/364 X |
| 5,385,253 | 1/1995 | Scharf et al. | 215/296 |

FOREIGN PATENT DOCUMENTS

| | | | |
|---|---|---|---|
| 803505 | 2/1936 | France . | |
| 799790 | 6/1936 | France . | |
| 1121397 | 8/1956 | France | 215/355 |
| 809040 | 7/1949 | Germany | 215/300 |
| 3521866 | 1/1987 | Germany | 215/355 |
| 08040446 | 2/1996 | Japan . | |
| 640216 | 7/1950 | United Kingdom . | |
| 324300 | 1/1990 | United Kingdom . | |

*Primary Examiner*—Allan N. Shoap
*Assistant Examiner*—Robin A. Hylton
*Attorney, Agent, or Firm*—Wenderroth, LInd & Ponack, L.L.P.

[57] ABSTRACT

A cork cap having a head and a leg and adapted to be inserted in a bottle mouth. A cork is press-fitted in the cap so that its bottom end protrudes from the bottom of the leg and is pressed against the inner surface of the bottle mouth to seal the bottle mouth. The cork can be pulled out by pulling the cork cap while twisting it. Protrusions are formed on the inner periphery of the tapered inner surface of the head between adjacent ones of a plurality of vertical ribs. The protrusions bite into the cork, thus keeping the cork strongly coupled to the cork cap even when the latter is pulled and twisted. Thus, the cork can be reliably pulled out together with the cork cap by twisting and pulling only the cork cap.

18 Claims, 10 Drawing Sheets

CORK CAP FOR USE WITH A CORK TO PLUG THE MOUTH OF A BOTTLE

BACKGROUND OF THE INVENTION

This invention relates to a cork cap which is inserted in a bottle mouth before plugging the bottle with a cork. Once the bottle is plugged, the bottle mouth is completely sealed as with an ordinary bottle plugged solely with a cork. The cork can be pulled out together with the cork cap simply by pulling the cork cap without using a corkscrew or any other bottle opener.

The inventor of this application proposed a cork cap of the above-mentioned type which makes it possible to pull out a cork plugged into a bottle, e.g. a wine bottle simply, by pulling the cork cap with both hands without using a cork screw (Examined Japanese Utility Model Publication 4-27836 and Unexamined Japanese Patent Publication 8-40446). FIGS. 10A and 10B show this cork cap.

The cork cap shown in FIGS. 10A and 10B is a plastic molding comprising a head 2 having an outer diameter greater than the inner diameter of a bottle mouth 1, and a leg 3 provided concentrically with the head 2 and having an outer diameter substantially equal to the inner diameter of the bottle mouth 1. The entire length of the cork cap, i.e. the sum of the lengths of the head 2 and the leg 3, is shorter than the length of the cork 4. The cork 4 is press-fitted into a hole 5 formed through the head 2 and the leg 3.

Part of the hole 5 formed in the head 2 is tapered so that its diameter increases gradually upward. A plurality of vertical ribs 6 are provided on the inner periphery of the hole 5, extending from the head 2 to the leg 3.

With the leg 3 of the cork cap inserted in the bottle mouth 1, the cork 4 is plugged into the bottle mouth 1. In this state, the portion of the cork 4 protruding downward from the leg 3 is pressed hard against the inner surface of the bottle mouth 1, sealing the bottle mouth 1. The cork 4 can be pulled out simply by holding the head 2 of the cork cap and pulling it.

In the figure, a slit 8 is shown to be formed in a thin portion 7 of the leg 3.

When a cork is plugged into a bottle mouth with the above cork cap inserted in the bottle mouth, the bottle mouth is sealed by the cork 4. The content of the bottle such as wine can perspire through the cork 4. The cork cap plays no role in these functions.

A problem is how to pull out the cork reliably by pulling the cork cap. In the above conventional arrangement, the tapered inner surface of the hole formed in the head 2 mainly serves this purpose. That is, the tapered surface prevents the cap from separating from the cork when the former is pulled out. The vertical ribs 6 increase the frictional force between the cap and the cork when the former is turned.

But it is desired to couple the cap and the cork more rigidly to prevent the cap from separating from the cork when the former is pulled.

An object of this invention is to increase the resistance to the force that acts to separate the cork and the cork cap when a pulling force is applied to the latter by providing the cap with means that can strongly bite the cork.

SUMMARY OF THE INVENTION

According to this invention, there is provided a cork cap for a bottle comprising a head having an outer diameter greater than the inner diameter of the mouth of the bottle, a leg provided concentrically with the head and having an outer diameter substantially equal to the inner diameter of the bottle mouth, the head and leg having lengths, the sum of which is smaller than the length of a cork, the cork cap being formed with a hole extending through the head and the leg, the hole formed in the head being tapered radially outwardly from its bottom to top, a plurality of vertical ribs formed on the inner surface of the hole and extending vertically from the head to the leg, and means for preventing the separation of the cork cap from the cork when the cork cap is pulled to remove the cork.

Instead of the horizontal ribs, protrusions may be formed on the inner surface of the portion of the hole formed in the head between adjacent ones of the vertical ribs, each of the protrusions having a lower front surface extending vertically or tapered radially outwardly from its bottom to top, and an upper front surface connecting at its bottom with the top of the lower front surface along a horizontal ridge and tapered radially outwardly toward its top from the ridge.

Instead of such horizontal ribs or protrusions, each of the vertical ribs may be formed with a radially inwardly protruding step at its portion disposed in the head.

In any of the arrangements, the cork can be more strongly coupled to the cork cap than in conventional arrangements.

Other features and objects of the present invention will become apparent from the following description made with reference to the accompanying drawings, in which:

DETAILED DESCRIPTION OF THE PREFERRED EMBODIMENT

Figure 1:
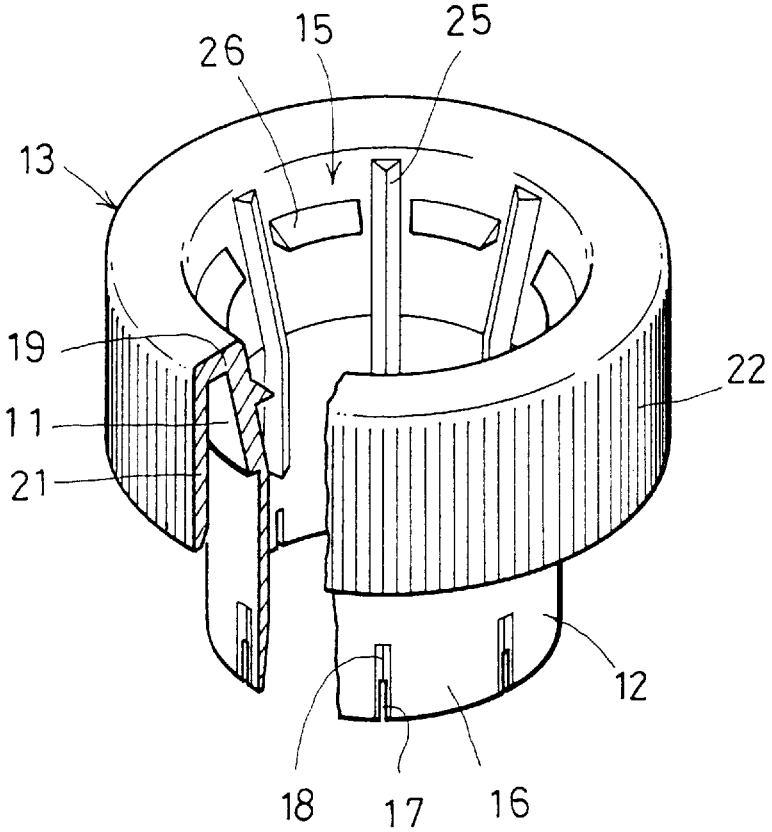
FIG. 1 is a partially cut-away perspective view of a first embodiment.
Figure 2A:
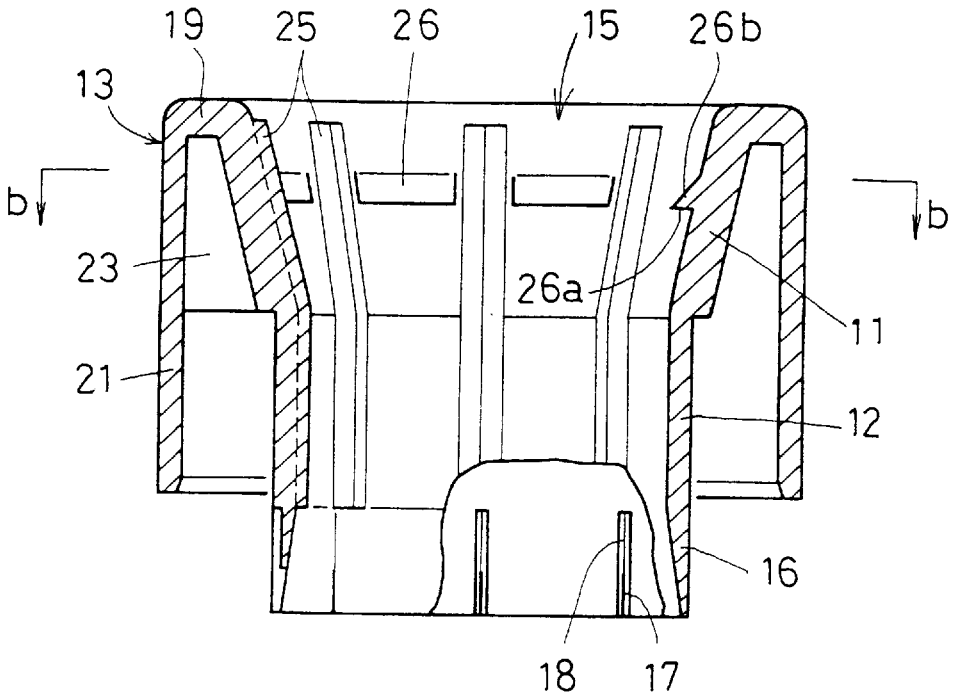
FIG. 2A is a sectional view of the first embodiment.
Figure 2B:
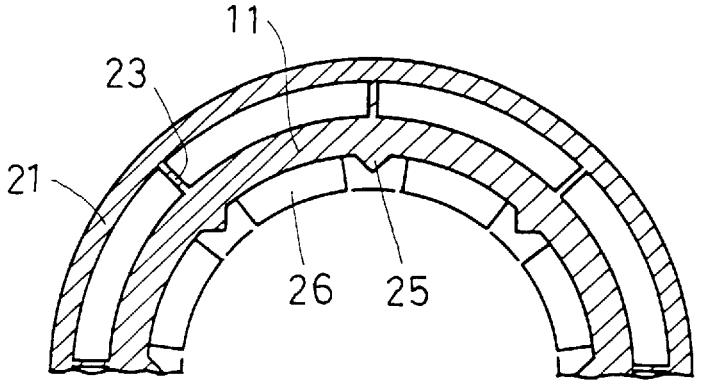
FIG. 2B is a partial sectional view taken along line 2B—2B of FIG. 2A.
Figure 3:
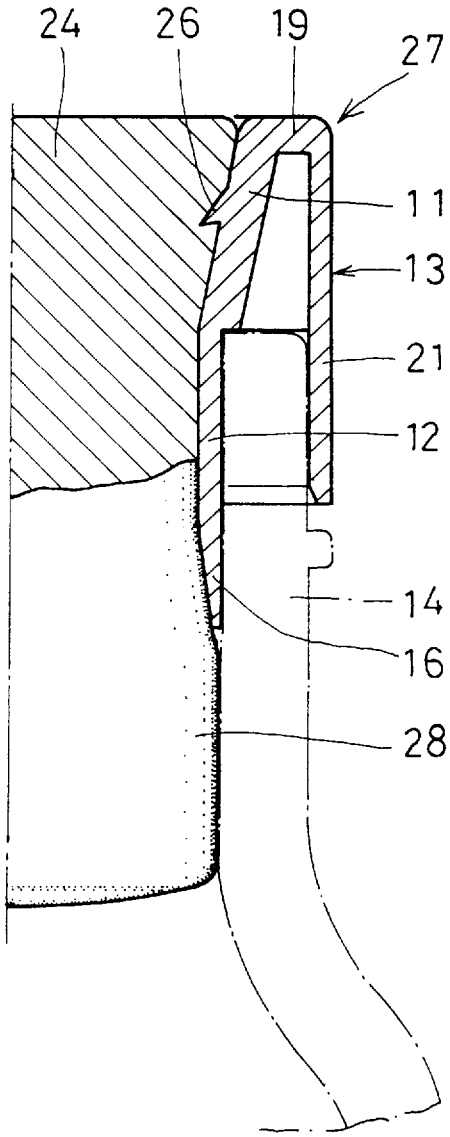
FIG. 3 is a partial enlarged sectional view of the the first embodiment showing how it is used.

FIGS. 1–3 show a cork cap of the first embodiment, which is, like the conventional cap, a plastic molding. It comprises a head 11, a leg 12 concentrically provided at the bottom end of the head 11, and a cover 13 integrally connected to the top of the head 11.

The head 11 is tapered so that its inner diameter is greater at the top than at the bottom. Its outer diameter at its bottom is greater than the inner diameter of a bottle mouth 14 (see FIG. 3) so that the bottom of the head 11 rests on the bottle mouth 14. The leg 12 is cylindrical and has an outer diameter substantially equal to the inner diameter of the bottle mouth 14.

A hole 15 is formed through the head 11 and the leg 12. The portion of the hole 15 formed in the head 11 is tapered so that its diameter increases gradually upward. The portion of the hole 15 at the bottom of the leg 12 is tapered so that its diameter increases gradually downward. Thus, the wall of the leg 12 is thin at the bottom. The thin portion 16 of the leg is formed with a plurality of slits 17 extending vertically from the bottom end of the leg. A V-shaped groove 18 is formed so as to connect with the top end of each slit 17.

The cover 13 comprises a flange 19 extending radially outwardly from the top of the head 11, and a cylindrical portion 21 extending downward from the outer edge of the flange 19. The cylindrical portion 21 extends to a level near the top end of the thin portion 16 of the leg 12, covering the bottle mouth 14 (FIG. 3). A nonslip surface 22 is formed on the outer periphery of the cylindrical portion 21.

Reinforcing radial ribs 23 are provided, circumferentially spaced from each other, between the outer periphery of the head 11 and the inner periphery of the cylindrical portion 21 (FIG. 2B).

The sum of the lengths of the head 11 and the leg 12 is shorter than the length of the cork 4 (FIG. 3). A required number of vertical ribs 25 are formed at required circumferential intervals on the inner periphery of the head 11 and the leg 12. The ribs 25 extend to the top end of the thin portion 16 of the leg 12. They have a triangular section (FIG. 2B).

Horizontal ribs 26 are formed on the inner periphery of the head 11 between and spaced from the adjacent vertical ribs 25. The horizontal ribs 26 have a triangular section with a horizontal bottom surface 26*a* and an inclined top surface 26*b*, as shown in FIG. 2A. The horizontal ribs 26 are slightly higher (i.e. protrude slightly further inwardly) than the portions of the vertical ribs 25 at the level of the horizontal ribs 26 (FIG. 2B).

In use, with the leg 12 of the cork cap 27 (FIG. 3) inserted in the bottle mouth 14 and the head 11 resting on the bottle mouth 14, the cork 24 is plugged in. The cork 24 is an ordinary column-shaped cork. It is compressed when it passes through the leg 12. When its bottom end 28 protrudes from the bottom end of the leg 12, it expands to be pressed hard against the inner periphery of the bottle mouth 14, sealing the bottle mouth. If the bottle mouth 14 is slightly oversized, the slits 17 will widen and the V-shaped grooves 18 may be torn, thereby spreading the leg's bottom.

As the cork 24 is pushed into the bottle mouth, it is deformed along the tapered inner surface of the head 11, while the vertical and horizontal ribs 25 and 26 bite into the cork 24.

The tapered inner surface and the horizontal ribs 26 formed on the head 11 will keep the cork strongly coupled to the cork cap when the cork cap 27 is pulled up. The vertical ribs 25 allow the cork 24 to rotate with the cork cap 27 when the latter is twisted. Thus, by pulling the cork cap 27 while twisting it by hand, the cork 24 together with the cork cap 27 can be pulled out of the bottle mouth 14.

Figure 4:
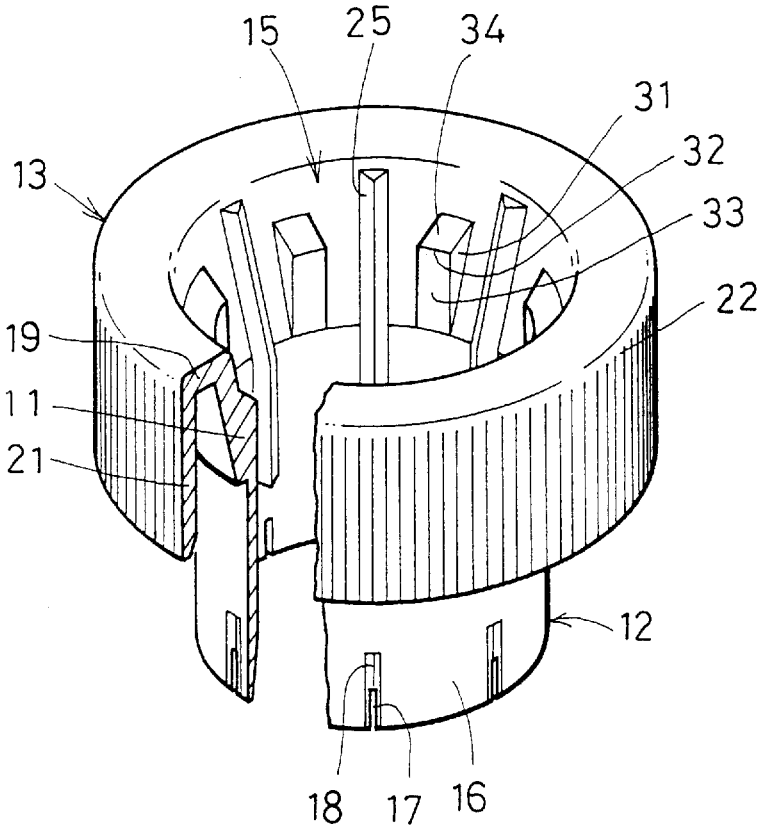
FIG. 4 is a partially cut-away perspective view of a second embodiment.
Figure 5A:
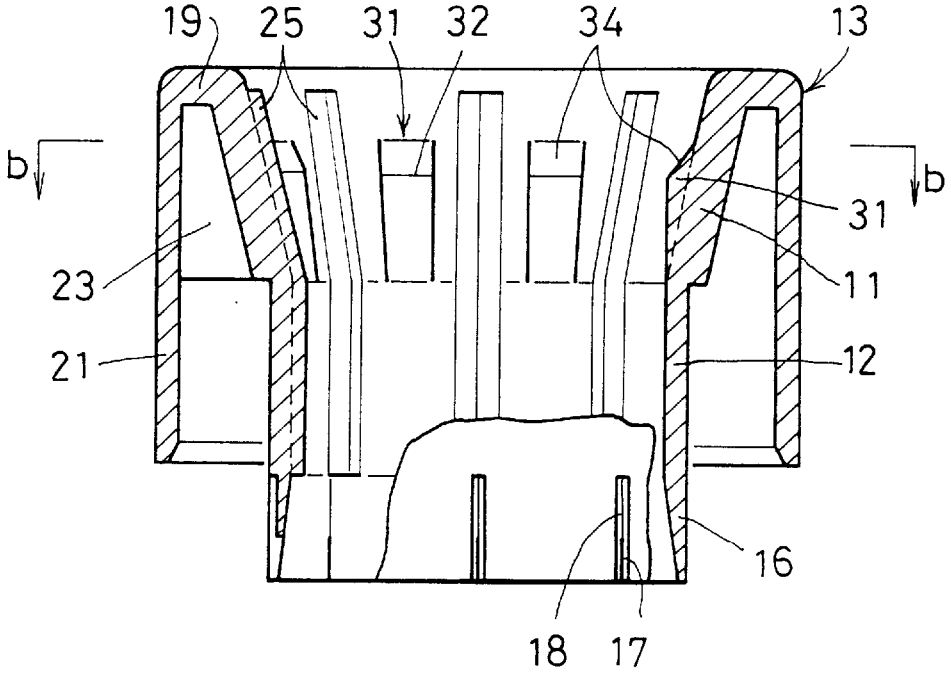
FIG. 5A is a sectional view of the second embodiment.
Figure 5B:
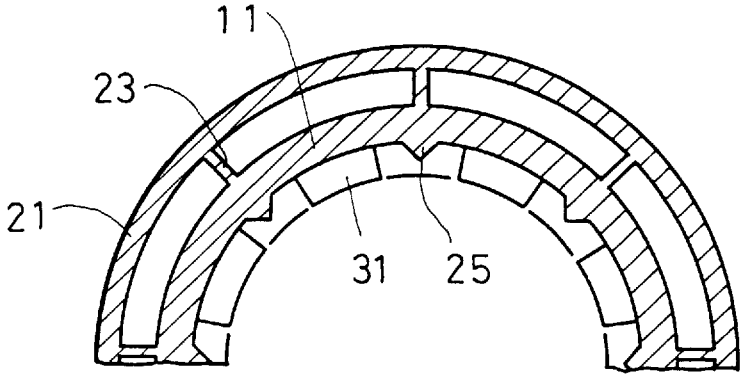
FIG. 5B is a sectional view taken along line 5B—5B of FIG. 5A.
Figure 6:
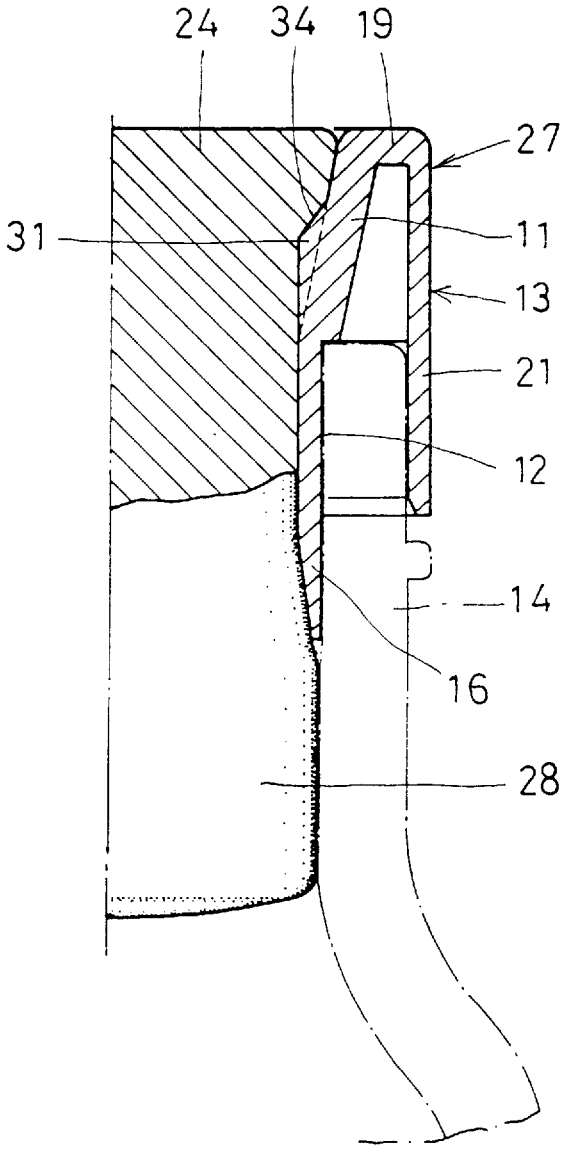
FIG. 6 is a partial enlarged sectional view of the the first embodiment showing how it is used.

The horizontal ribs 26 of the first embodiment are inversely tapered, so that a complicated mold has to be used to form the cork cap 27. The second embodiment shown in FIGS. 4–6 is free of this problem.

In the second embodiment, protrusions 31 are formed on the inner periphery of the head 11 between the adjacent vertical ribs 25. They are each elongated in the vertical direction with a constant width over the entire length. Each protrusion 31 has a lower front surface 33 extending vertically upward from the bottom end of the head 11 (FIG. 5A), and a tapered upper front surface 34 extending obliquely upwardly so that its top end is radially outside of its bottom end. A horizontal ridge 32 is defined between the lower and upper surfaces 33 and 34.

The lower front surface 33 may be tapered radially outward from its bottom toward the ridge 32.

Since the protrusions 31 are not inversely tapered, the cork cap of this embodiment can be formed using a less complicated mold. The upper front surface 34 of each protrusion 31 serves to keep the cork 24 strongly coupled to the cork cap when the latter is pulled.

Otherwise, this embodiment is the same as the first embodiment.

Figure 7:
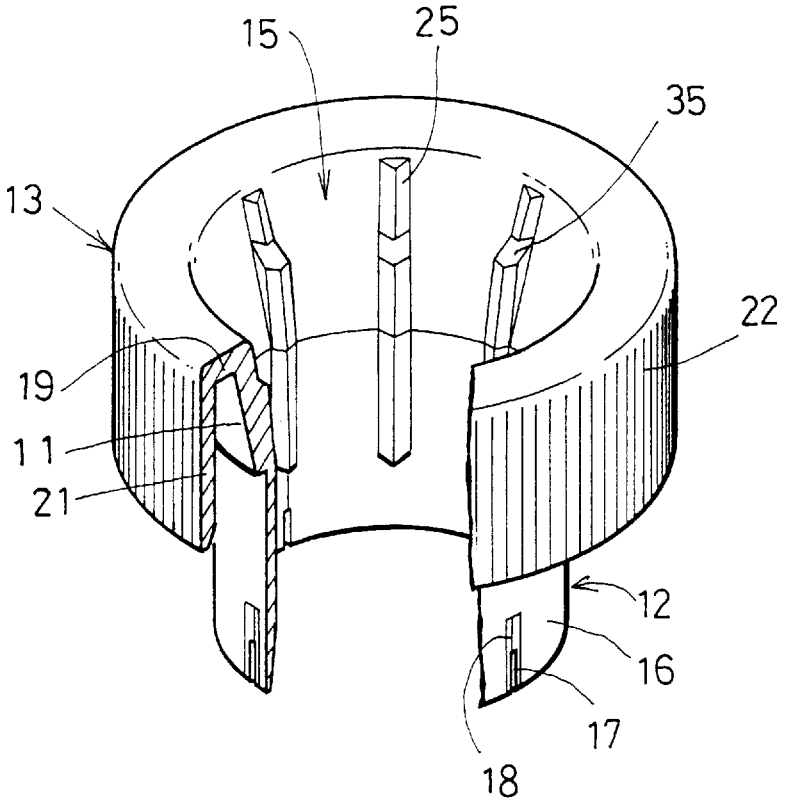
FIG. 7 is a partially cut-away perspective view of a third embodiment.
Figure 8A:
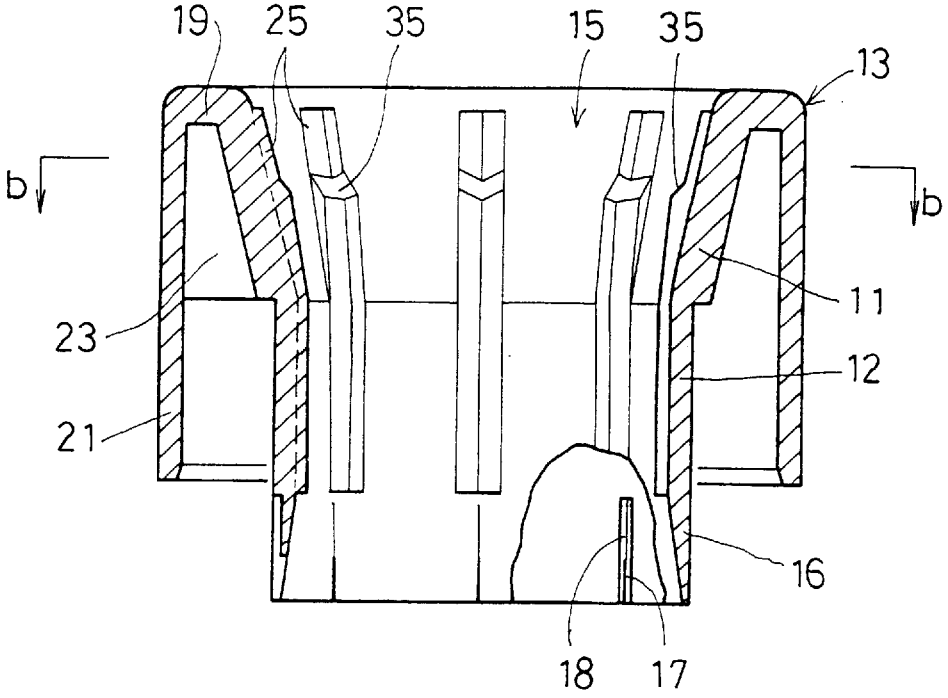
FIG. 8A is a sectional view of the third embodiment.
Figure 8B:
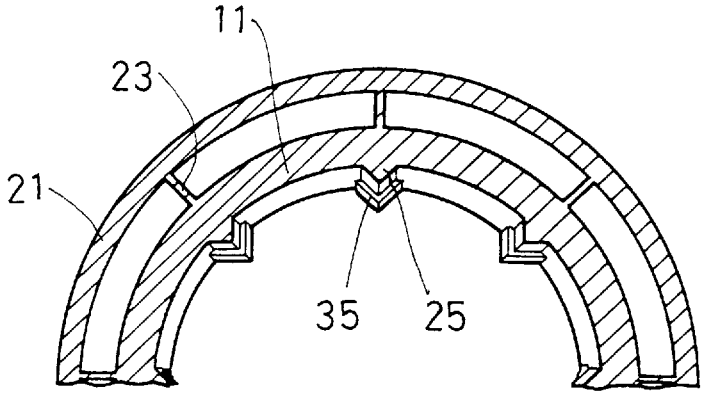
FIG. 8B is a sectional view taken along line 8B—8B of FIG. 8A.
Figure 9:
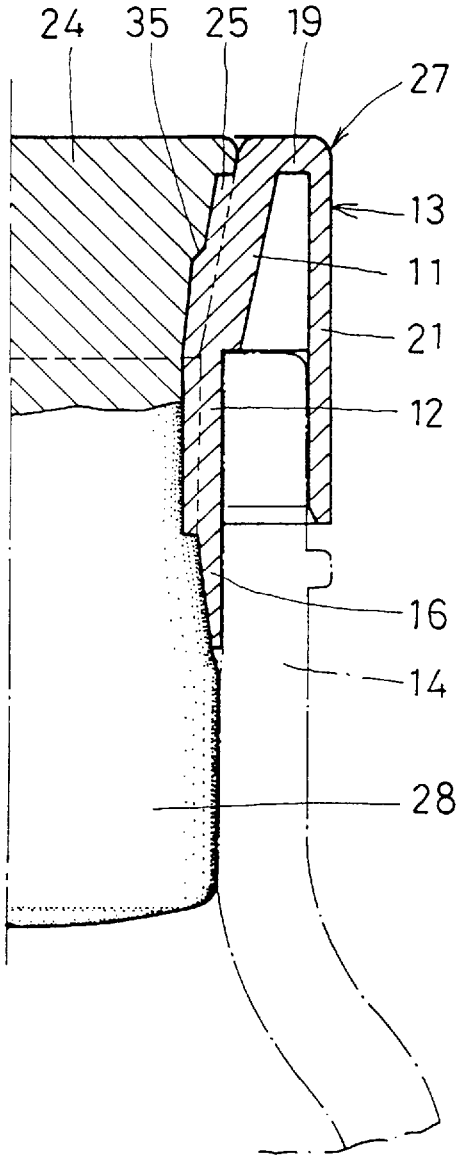
FIG. 9 is a partial enlarged sectional view of the third embodiment showing how it is used.
Figure 10A:
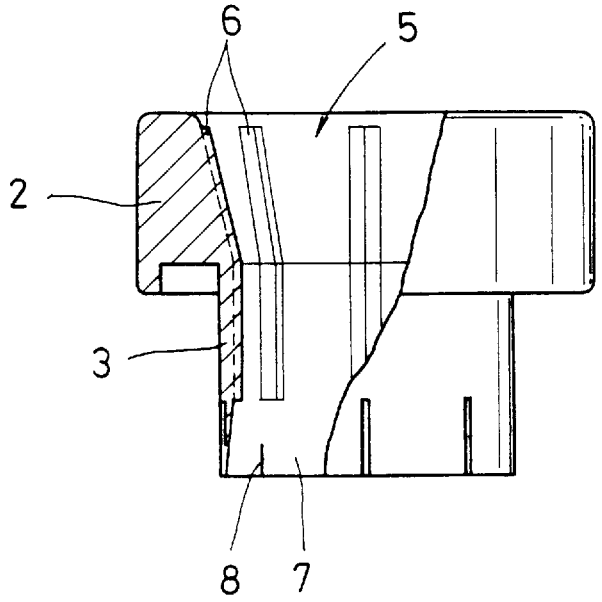
FIG.10A PRIOR ART
FIG. 10A is a sectional view of the prior art.
Figure 10B:
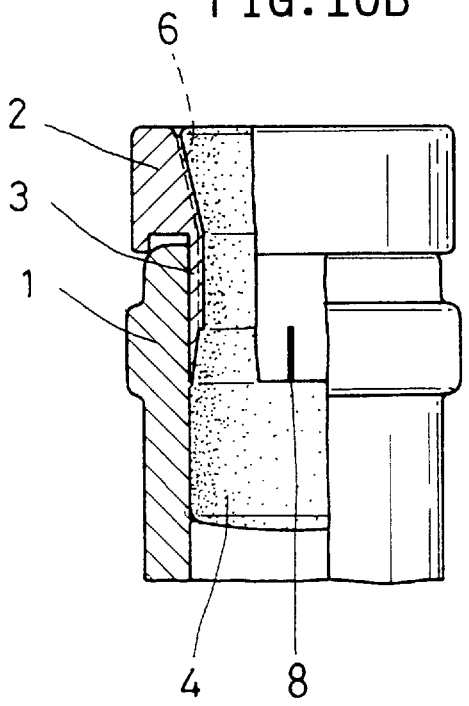
FIG.10B PRIOR ART
FIG. 10B is a sectional view of the same as used with a cork.

FIGS. 7 to 9 show the third embodiment, in which each vertical rib 25 has a radially inwardly extending step 35 midway of its length. Since the ribs 25 have a V-shaped cross-section, the steps 35 are also V-shaped as viewed from above (FIG. 8B). The steps 35 also serve to keep the cork strongly coupled to the cork cap when the latter is pulled. Otherwise, this embodiment is the same as the first embodiment.

The horizontal ribs, protrusions and steps formed on the inner periphery of the head of the cork cap increase the force with which the cork is coupled to the cork cap when the latter is pulled, thus making it possible to pull out the cork together with the cap with high reliability.

What is claimed is:

1. A cork cap for use with a cork to plug a bottle mouth, said cork cap comprising:

a head having an outer diameter greater than a given diameter;

a leg provided concentrically with said head and having an outer diameter substantially equal to said given diameter;

wherein a hole is formed through said head and said leg, with inner surfaces of said head and said leg defining an inner surface of said hole;

wherein said hole has a top portion and a bottom portion and is tapered radially outwardly from said bottom portion to said top portion;

wherein a plurality of vertical ribs are formed on said inner surface of said hole and extend vertically from said head to said leg; and wherein a plurality of horizontal ribs are formed on said inner surface of said hole between adjacent ones of said vertical ribs.

2. A cork cap as recited in claim 1, wherein said horizontal ribs serve to prevent separation of said cork cap from the cork when said cork cap is pulled to remove the cork from the bottle mouth.

3. A cork cap as recited in claim 1, wherein each of said horizontal ribs has a top surface inclined radially inwardly and downwardly.

4. A cork cap as recited in claim 3, wherein each of said horizontal ribs has a substantially horizontal bottom surface.

5. A cork cap as recited in claim 1, wherein each of said vertical ribs is substantially V-shaped in cross section.

6. A cork cap as recited in claim 1, wherein at a vertical level of said horizontal ribs, said horizontal ribs protrude radially inwardly further than said vertical ribs.

7. A cork cap for use with a cork to plug a bottle mouth, said cork cap comprising:

a head having an outer diameter greater than a given diameter;

a leg provided concentrically with said head and having an outer diameter substantially equal to said given diameter;

wherein a hole is formed through said head and said leg, with inner surfaces of said head and said leg defining an inner surface of said hole;

wherein said hole has a top portion and a bottom portion and is tapered radially outwardly from said bottom portion to said top portion;

wherein a plurality of vertical ribs are formed on said inner surface of said hole and extend vertically from said head to said leg;

wherein a plurality of protrusions are formed on said inner surface of said hole, each of said protrusions being formed between adjacent ones of said vertical ribs; and wherein each of said protrusions has a top portion, a bottom portion, a lower front surface extending generally vertically from said bottom portion to said top portion of said protrusion, and an upper front surface having a bottom and a top and connecting, at said bottom, with a top of said lower front surface along a horizontal ridge and being tapered radially outwardly toward said top from said horizontal ridge.

8. A cork cap as recited in claim 7, wherein said protrusions serve to prevent separation of said cork cap from the cork when said cork cap is pulled to remove the cork from the bottle mouth.

9. A cork cap as recited in claim 7, wherein each of said vertical ribs is substantially V-shaped in cross section.

10. A cork cap as recited in claim 7, wherein at a vertical level of said horizontal ridges, said horizontal ridges protrude radially inwardly further than said vertical ribs.

11. A cork cap for use with a cork to plug a bottle mouth, said cork cap comprising:

a head having an outer diameter greater than a given diameter;

a leg provided concentrically with said head and having an outer diameter substantially equal to said given diameter;

wherein a hole is formed through said head and said leg, with inner surfaces of said head and said leg defining an inner surface of said hole;

wherein said hole has a top portion and a bottom portion and is tapered radially outwardly from said bottom portion to said top portion;

wherein a plurality of vertical ribs are formed on said inner surface of said hole and extend vertically from said head to said leg;

wherein a plurality of protrusions are formed on said inner surface of said hole, each of said protrusions being formed between adjacent ones of said vertical ribs; and wherein each of said protrusions has a top portion, a bottom portion, a lower front surface tapered radially outwardly from said bottom portion to said top portion of said protrusion, and an upper front surface having a bottom and a top and connecting, at said bottom, with a top of said lower front surface along a horizontal ridge and being tapered radially outwardly toward said top from said horizontal ridge.

12. A cork cap as recited in claim 11, wherein said protrusions serve to prevent separation of said cork cap from the cork when said cork cap is pulled to remove the cork from the bottle mouth.

13. A cork cap as recited in claim 11, wherein each of said vertical ribs is substantially V-shaped in cross section.

14. A cork cap as recited in claim 11, wherein at a vertical level of said horizontal ridges, said horizontal ridges protrude radially inwardly further than said vertical ribs.

15. A cork cap for use with a cork to plug a bottle mouth, said cork cap comprising:

a head having an outer diameter greater than a given diameter;

a leg provided concentrically with said head and having an outer diameter substantially equal to said given diameter;

wherein a hole is formed through said head and said leg, with inner surfaces of said head and said leg defining an inner surface of said hole;

wherein said hole has a top portion and a bottom portion and is tapered radially outwardly from said bottom portion to said top portion;

wherein a plurality of vertical ribs are formed on said inner surface of said hole and extend vertically from said head to said leg;

wherein a radially inwardly extending step is formed on each of said vertical ribs at a vertical level between a top of said vertical rib and a junction of said head and said leg.

16. A cork cap as recited in claim 15, wherein said radially inwardly extending steps serve to prevent separation of said cork cap from the cork when said cork cap is pulled to remove the cork from the bottle mouth.

17. A cork cap as recited in claim 15, wherein each of said vertical ribs is substantially V-shaped in cross section.

18. A cork cap as recited in claim 15, wherein each of said radially inwardly extending steps comprises a radially inwardly extending step surface.

* * * * *